US006508434B1

(12) United States Patent
Flores et al.

(10) Patent No.: US 6,508,434 B1
(45) **Date of Patent: *Jan. 21, 2003**

(54) BAILING AND AUTOMATIC STOWING SYSTEM FOR ELECTRIC CONDUCTORS

(75) Inventors: Clemente Lavie Flores, Querétaro (MX); Carlos Tenorio Gutierrez, Querétaro (MX); Silverio Gonzalez Lopez, Querétaro (MX)

(73) Assignee: Servicios Condumex S.A. de C.V., Queretaro (MX)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/124,011

(22) Filed: Jul. 29, 1998

(30) Foreign Application Priority Data

Aug. 25, 1997 (MX) ..... 976472

(51) Int. Cl.[7] ..... B65H 49/38
(52) U.S. Cl. ..... 242/594.3; 206/397
(58) Field of Search ..... 242/127, 129, 242/129.5, 594.3, 594.4, 594.5, 594.6, 130, 134, 137, 139; 206/386, 397, 403, 503, 509, 512, 513, 389, 395, 396, 413, 415

(56) References Cited

U.S. PATENT DOCUMENTS

| | | | | | |
|---|---|---|---|---|---|
| 2,302,850 | A | * | 11/1942 | Funke | 242/594.3 |
| 2,340,116 | A | * | 1/1944 | Ferguson et al. | 242/594.3 |
| 2,943,732 | A | * | 7/1960 | Kovaleski et al. | 242/129 |
| 3,109,540 | A | * | 11/1963 | Klimpl | 242/129 |
| 3,390,844 | A | * | 7/1968 | Dillow et al. | 242/129 |
| 3,520,409 | A | * | 7/1970 | Gibbs, Sr. | 242/594.4 |
| 3,602,455 | A | * | 8/1971 | Lewis | 242/129 |
| 3,902,679 | A | * | 9/1975 | Bost | 242/129 |
| 4,077,586 | A | * | 3/1978 | Thomas et al. | 242/129.5 |
| 4,202,509 | A | * | 5/1980 | Horn | 242/594.3 |
| 4,537,344 | A | * | 8/1985 | Thomas | 206/509 |
| 4,567,996 | A | * | 2/1986 | Muise | 206/509 |
| 4,623,063 | A | * | 11/1986 | Balkin | 206/397 |
| 4,664,260 | A | * | 5/1987 | Stokes | 242/129 |
| 4,709,852 | A | * | 12/1987 | Stoll | 206/509 |
| 4,763,854 | A | * | 8/1988 | Borowski | 242/129 |
| 4,826,100 | A | * | 5/1989 | Belliveau | 242/129 |
| 4,905,834 | A | * | 3/1990 | Mur Gimeno et al. | 206/512 |
| 5,037,027 | A | * | 8/1991 | Nichols | 206/512 |
| 5,078,332 | A | * | 1/1992 | Carter | 242/129 |
| 5,115,965 | A | * | 5/1992 | Girona Alepuz | 206/509 |
| 5,197,686 | A | * | 3/1993 | Okada et al. | 242/594.4 |
| 5,267,705 | A | * | 12/1993 | Hofrichter et al. | 242/129 |
| 5,370,303 | A | * | 12/1994 | Fry | 206/509 |
| 5,452,803 | A | * | 9/1995 | Stromberg | 206/503 |
| 5,607,052 | A | * | 3/1997 | Liepold et al. | 206/397 |
| 5,697,500 | A | * | 12/1997 | Walker | 206/509 |
| 5,713,469 | A | * | 2/1998 | Buscema | 206/397 |
| 5,722,552 | A | * | 3/1998 | Olson | 206/512 |
| 5,816,514 | A | * | 10/1998 | Duclos et al. | 242/129 |
| 5,921,391 | A | * | 7/1999 | Ortiz et al. | 242/137 X |

FOREIGN PATENT DOCUMENTS

| | | | | |
|---|---|---|---|---|
| GB | 2 278 829 A | * | 12/1994 | 242/129 |
| JP | 5-330734 | * | 12/1993 | 242/594.6 |
| SU | 1567668 A1 | * | 5/1990 | 242/594.6 |

* cited by examiner

*Primary Examiner*—William A. Rivera
(74) *Attorney, Agent, or Firm*—Carmen Pili Ekstrom; Erlinda Sarno

(57) ABSTRACT

The bailing and automatic stowing system is designed for the winding of electric conductors, particularly for automotive harnesses, and is characterized by an arrangement consisting of: a conventional cutting table with electronic control arranged in the reels as support of up to seven stacked packings; an octagonal packing of three octagonal cardboard or plastic pieces, specially designed for the electric conductor roll and a metal universal cabinet to accommodate up to four stowages of piled packings for their storage.

12 Claims, 6 Drawing Sheets

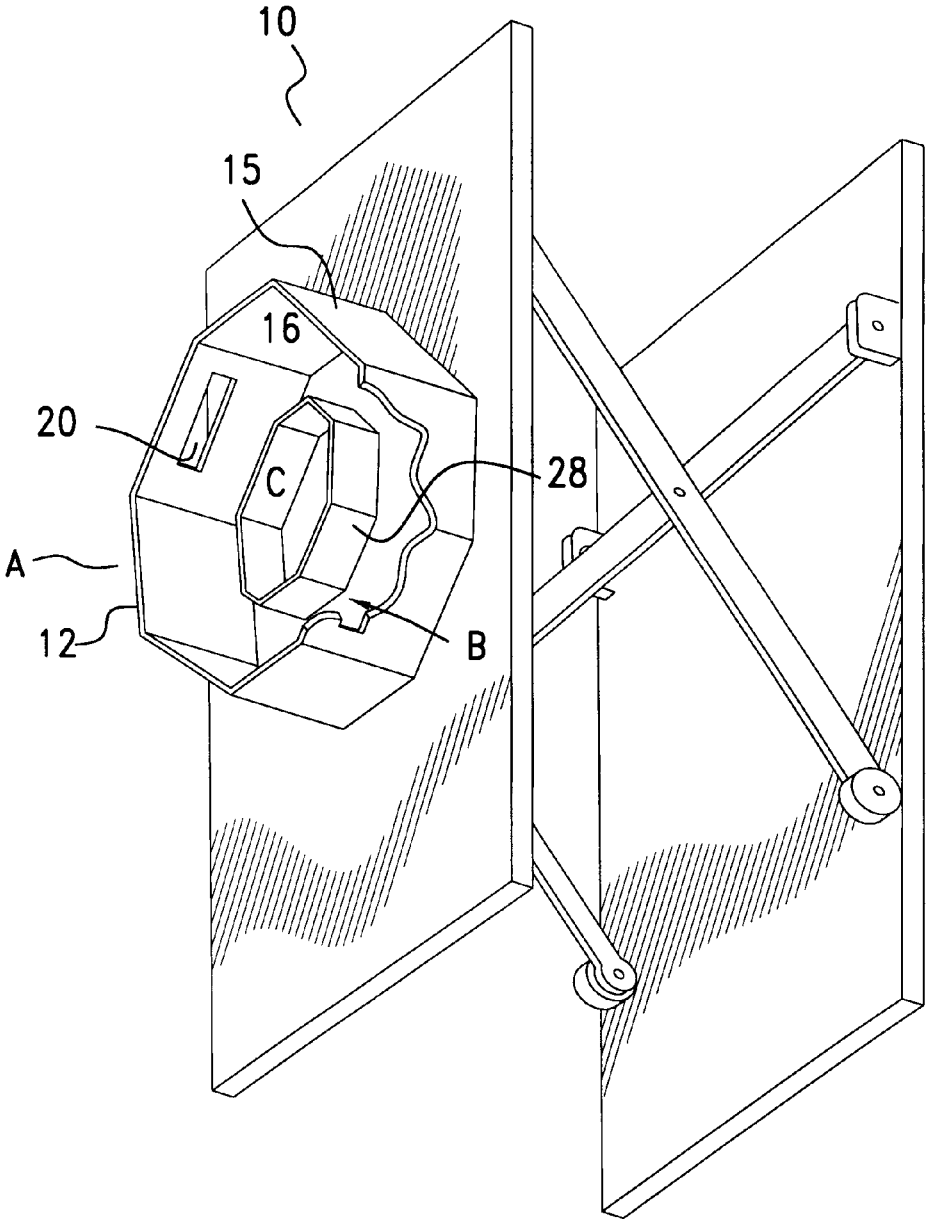
FIG.1.1

BAILING AND AUTOMATIC STOWING SYSTEM FOR ELECTRIC CONDUCTORS

BACKGROUND OF THE INVENTION

There are different ways or designs for packing electric conductors, which are semiautomatic, automatic, or in manual mode. These designs are affected by the way the rolls are packed, whether they are in common reinforced cardboard boxes or with a hoop for transportation purposes or in cylindrical cardboard drums which usually weigh over 100 kg.

In order to reduce inventories and distribution costs, the applicant has designed a bailing and automatic stowing system for electric conductors. This system offers cable presentations seven times smaller compared to the traditional packing in 30-inch high cardboard drums.

The packing presentation of a smaller quantity of cable made it possible to have more flexibility in cutting operations, since it allows cutting the same product in several machines and having more than one 6-inch high package in a machine when required.

Moreover the presentation in a package of a smaller quantity which is an object of the present invention made handling easier for the users, because the conventional drum weight is about 120 kg., while the 6-inch high package (about 15 cm) presents a maximum weight of 20 kg.

The same package can be used several times, which is an advantage for the user and the supplier.

The internal transport of the packaged product is easier because it includes in the packing a rack that allows the use of two superposed stowages on two levels. For shipment, the product is placed in two superposed wooden stowages that correspond to the capacity of a trailer.

DESCRIPTION OF THE INVENTION

Hereinafter the invention will be described according to the drawing of the FIGS. 1 to 8, where:

FIG. 1 shows the bailing and stowing system from an isometric view on an automatic cutting table of electric conductors rolls for automotive harnesses.

FIG. 1.1 shows an isomeric view of a sectional cut of FIG. 1, with one individual packing.

FIG. 2 shows a top view of an individual, octagonal cardboard packing for electric conductor rolls.

FIG. 2*a* illustrates the assembly sections A, B and C of packing.

Figure 1:
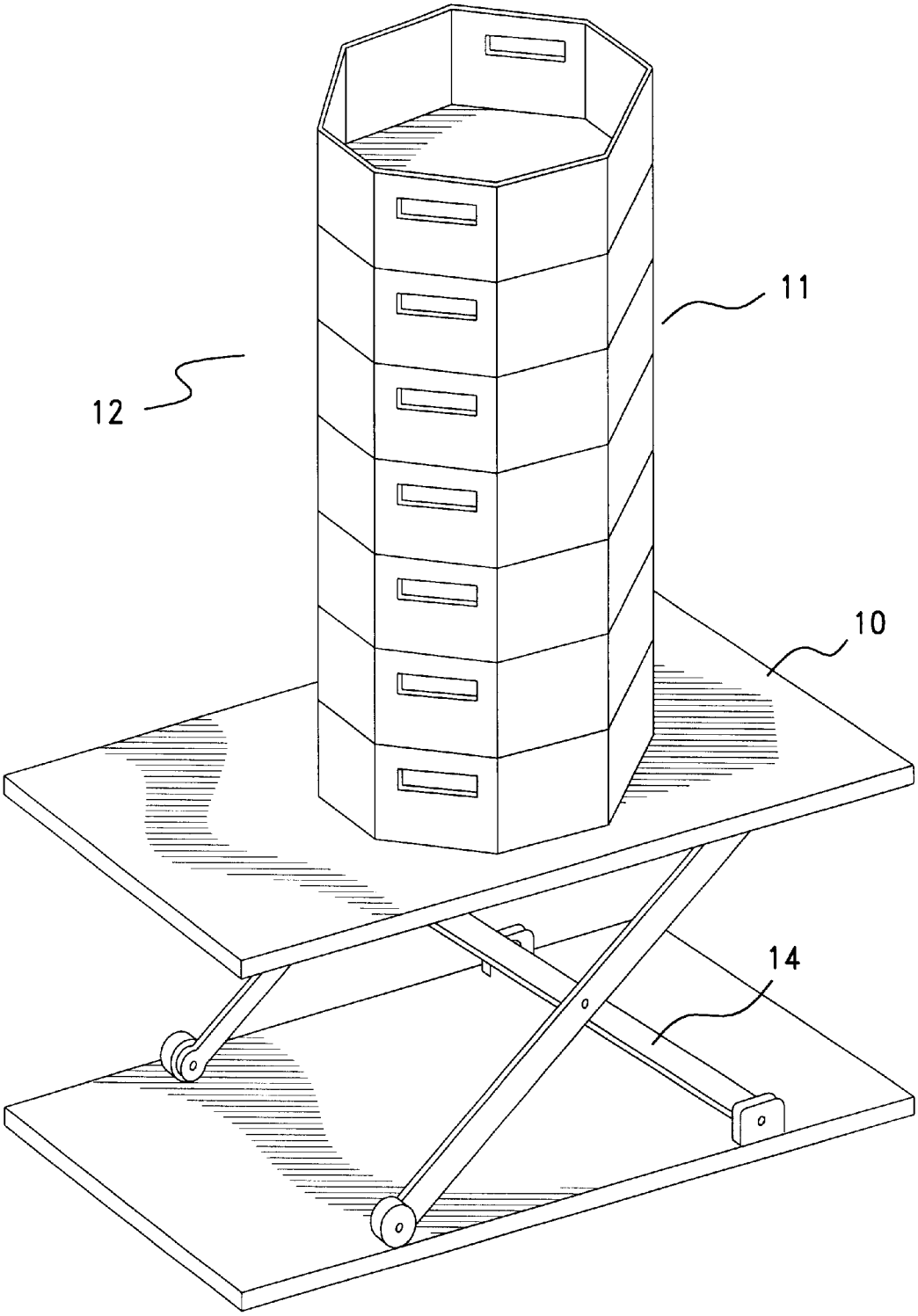

The bailing and stowing system shown in FIG. 1 is integrated by a conventional cutting table 10, that is electrically and automatically set and controlled at the desired height through its supports 14, to handle the stowage of module 11, during the rolling of electric conductor rolls for automotive harnesses the seven packings 12 typically made of cardboard and plastic. Each of the packing supports 20 to 25 kg.

Figure 8:
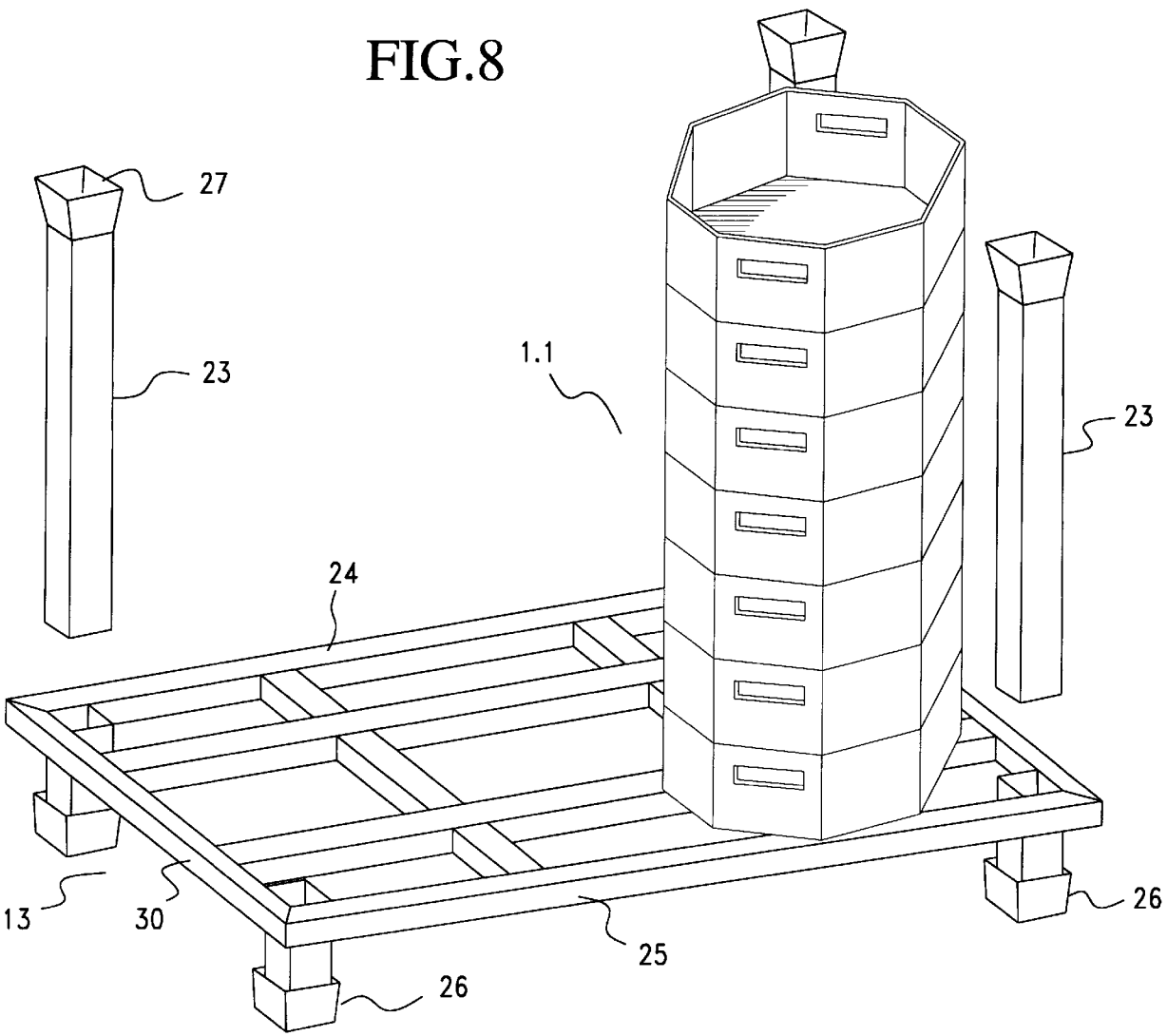
FIG. 8 shows an isometric view of the structure of a rack, with a module of seven packings.

A portable rack 13 FIG. 8 with four modules specially designed to be used as container for the internal transportation or storage of the stowage.

Figure 2:
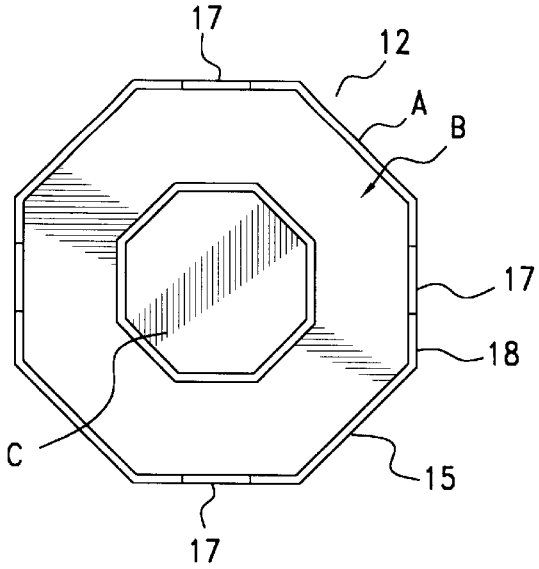
Figure 3:
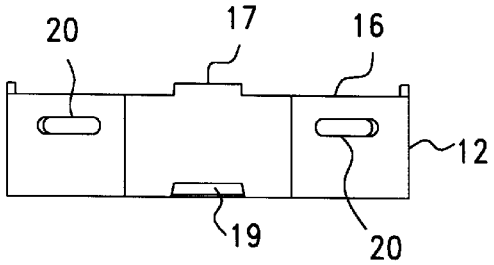
FIG. 3 shows a lateral view of FIG. 2.
Figure 4:
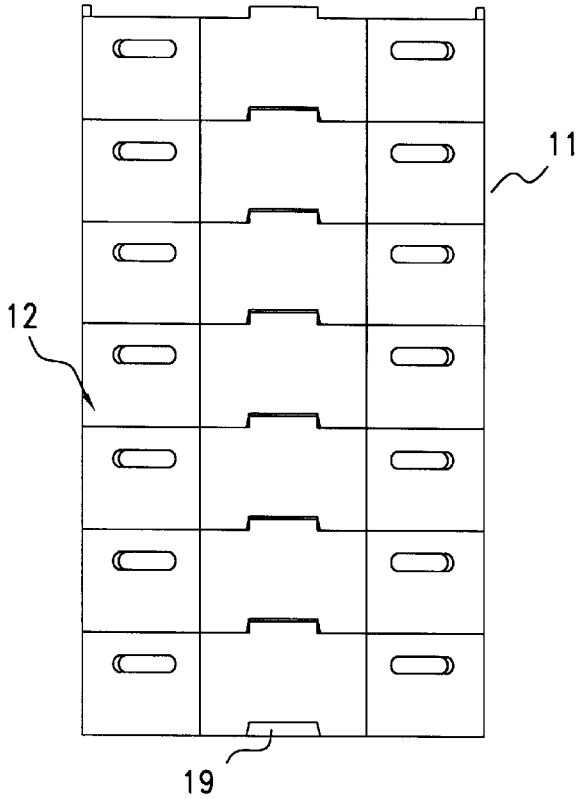
FIG. 4 shows a lateral side of a stowage with seven modules of stacked packings.
Figure 2A:
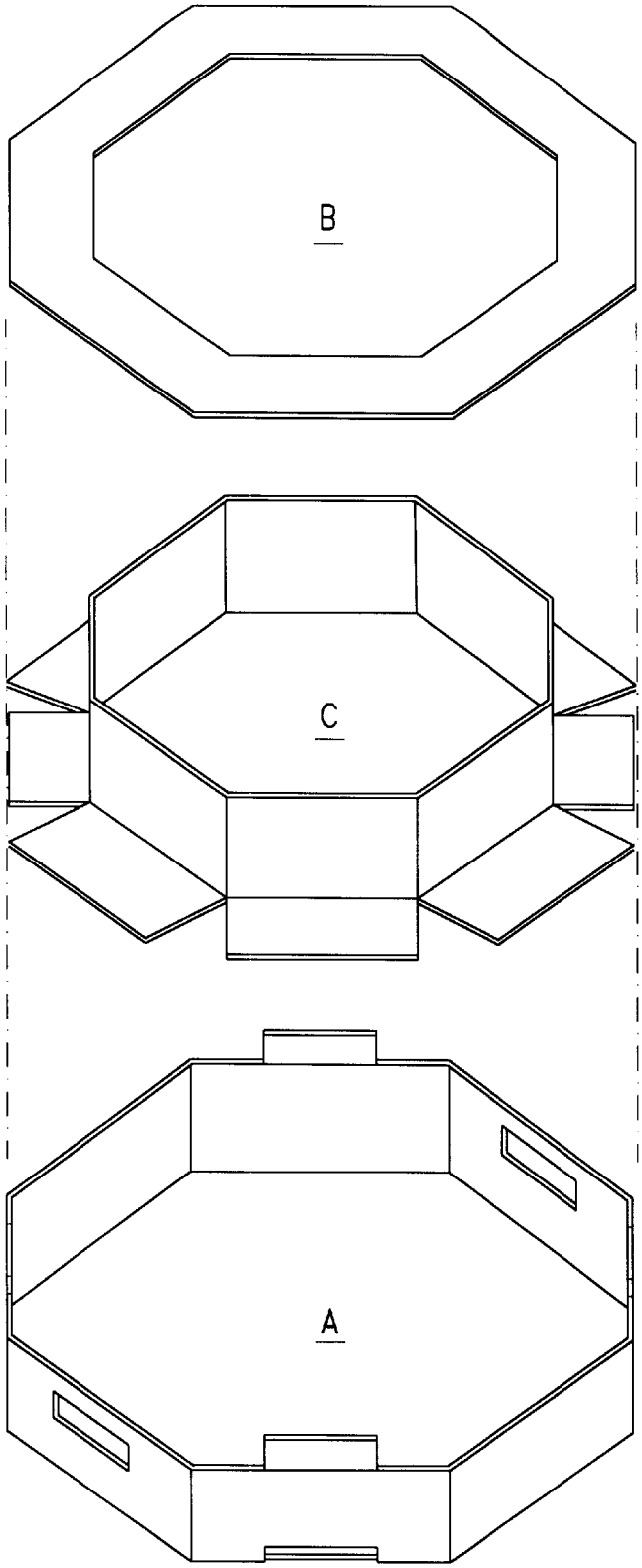
Figure 5:
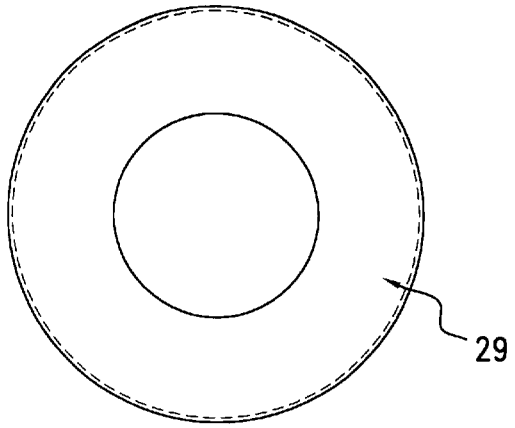
FIG. 5 shows a top view of an electric conductor roll.
Figure 6:
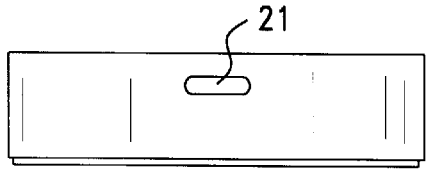
FIG. 6 shows a lateral view of FIG. 2.
Figure 7:
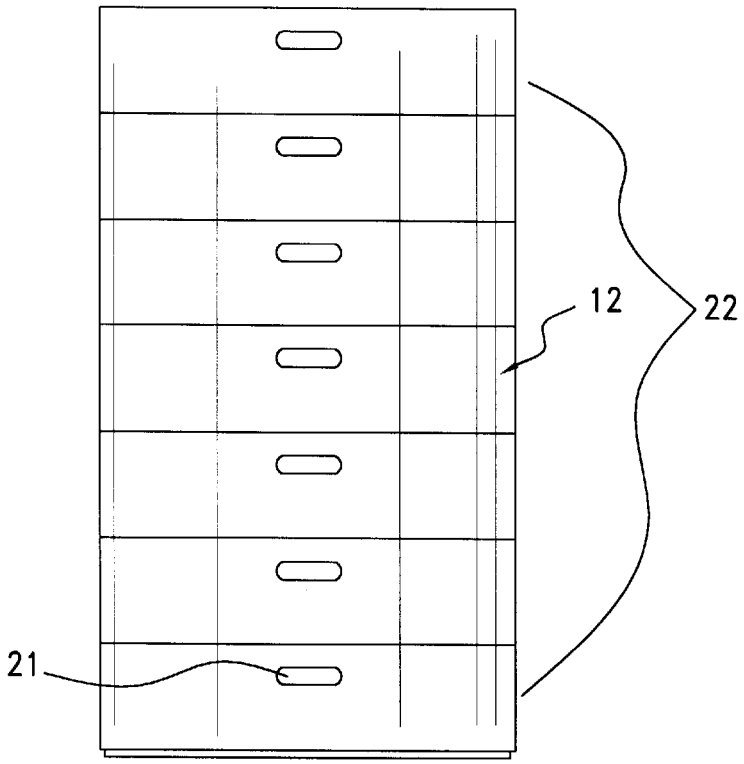
FIG. 7 shows a lateral view of a module of seven piled packings inside a rack of four modules, for storage.

The cardboard packing 12 FIG. 2, and 1.1 is designed in three detachable sections A, B, C. The A section is structured as an octagonal container made of a one piece cardboard having two bends. A first bend on every side of the octagonal surface 15, in its bottom periphery extending upwards to approximately 15 cm. to form a peripheral wall 31 and a second bend 16 at 15 cm. from the first bend extending downwards to approximately 15 cm. to form a reinforcement 18 of the peripheral wall. The second bend 16 after the bend 15 cm. from the first bend also forms the top of the peripheral wall 15. Alternately disposed on four of its 8 sides are projections 17 reinforced with an additional wall 18 to allow the packing 12 to self-stack with each other to a maximum of 7 packings to form a stowage 11. Moreover, the packing 12 has a rabbet 19, in the opposite furthest end of the projection 17, formed by a folding of two walls, that allows coupling of the adjacent projection 17 with the piled packing. The packing presents in two of its opposites walls, longitudinal hollows that work as handles 20 of the packing.

The B section of the packing 12 is a reinforcement sheath peripherally disposed at a bottom of a space between the A section and the C section; the internal and external peripheries of this sheath are octagonal.

The C section of the packing is an octagonal bridle 28, FIG. 1.1 situated concentrically relative to the A section. This bridle has the same height as that of the A section. In its lower ends, it also has flanges working as fastening elements that are pressed between the A section and the B section, to define a passage where the electric winding 29 is accommodated.

The cardboard packing 12, when manufactured with plastic material, may or may not have projections 17 for its self stacking or just have manual handles 21. Up to seven stowages 22 can be self-stacked.

Operation

The packings were designed to be self-stacked, this permits them to be automatically stowed and filled one by one with the reels or coils of automotive cable being supported on the cutting table. The seven packings are filled one by one until they form a stowage, continuity tests are automatically made on the reels.

Once the seven packings are filled they are removed from the reel being assisted by the cutting table and by a roller conveyor.

When the packings are ready to be stored, they are set in the four modules 11 of the rack 13. The four posts 23 are set and another rack is stowed to send them to a double level.

The Objects of the System of the Invention are

Reduction of Process Inventory

The 6-inch high packing capacities are seven times smaller than the capacities of the packing in 30-inch high drums.

Handling Facilities

Conventional 30-inch drums weigh up to 120 kg which makes their handling difficult, while the 6 inch packings herein weigh 20 kg. maximum and are equipped with handles to help the operators in handling them without any difficulty.

Reuse

The 6-inch packings can be reused several times; this means that the distribution costs will be reduced.

Reduction of Obsolete Inventories

When a product is not of high consumption, there is an opportunity to ask for it in smaller amounts so when the automotive model is changed, the risk of having it as obsolete inventory is reduced.

Reduction of Polluting Material

The 6-inch high packing is made of 100% cardboard or 100% polyethylene, and thus has a smaller amount of substances that pollute the environment. The traditional drum has metal rings hooked to the lower and upper parts so that it is difficult to take them away from the cardboard.

Rack 13 Description FIG. 8

A Universal rack is provided to store the cable packings for several uses.

The rack can accommodate the following:

6-inch high octagonal cardboard packing; distance between opposite faces=60 cm.

Round cardboard packing height=6 inches; diameter: 60 cm.

Cardboard drums=60 cm diameter and various heights: 15 inches, 21 inches, 30 inches and 42 inches.

The rack is a symmetric structure with a housing consisting of an articulated base 24 of tubular profiles 25 arranged in four rectangular sections to accommodate four stowages with seven octagonal packings 11, respectively. The rack 13 has a series of four rigid supports 23 vertically disposed in each corners of the base 24, the support having one end connecting to the base and an opposite end having a female support 27, the female support adaptable to a male support 26 on one end of each of the four feet of the base extending downwards, the four feet located in the lower part of the base for stacking the racks.

The rack has four packing accesses and its design permits to pile up to 3 racks, one on top of the other, being of adequate dimensions so they can be stored in the containers of trailers two by two, one on top of the other.

Having described the invention it is considered a novelty so the following is claimed:

What is claimed is:

1. A stackable, reusable, lightweight, and transportable bailing and automatic stowing system for electric conductors, having a packing for winding an electric conductor, the packing comprising:

an octagonal walled container having a bottom wall and eight walls extending upwardly from the bottom wall, each of the eight walls forming a first peripheral wall;

an octagonal bridle section having eight walls and being concentrically situated within the octagonal walled container, the octagonal bridle section having flanges extending radially outwardly toward each of the first peripheral walls, a passage being defined between the first peripheral walls and the octagonal bridle section walls, the passage defining a distance of approximately 60 inches between the first peripheral walls and the octagonal bridle section walls;

a sheath section having internal and external octagonal peripheries mounted within the passage and on top of the octagonal bridle section flanges for reinforcing the passage accommodating the electric conductor;

the octagonal walled container having a second peripheral wall extending downwardly from each of the tops of the first peripheral walls to form a reinforcement of each of the first peripheral walls, each of the first and second peripheral walls having a height in the range of 4 to 6 inches;

reinforced projections disposed on alternating sides of the second peripheral wall;

rabbets disposed on alternating sides on the bottom outer periphery of the octagonal walled container at positions opposite the reinforced projections for coupling with the reinforced projections when one packing is stacked on top of another packing having the same dimensions;

a symmetric rack comprising an articulated base of tubular profiles arranged in four rectangular sections to accommodate four stowages of packings, the rack having a series of four rigid supports with female end supports vertically disposed upwards from four corners of the base and four feet with male end supports, the four corners of the base enabling stacking of one symmetric rack with another symmetric rack.

2. The bailing and automatic stowing system of claim 1, wherein the octagonal walled container is of one piece.

3. The bailing and automatic stowing system of claim 1, wherein each of the first peripheral walls extend upwardly to approximately 15 cm before each of the second peripheral walls extend downwardly to another approximately 15 cm.

4. The bailing and automatic stowing system of claim 1, wherein four reinforced projections are alternately disposed on alternate sides of the second peripheral wall.

5. The bailing and automatic stowing system of claim 4, wherein the rabbets are coupled with the reinforced projections when a packing is stacked upon another packing.

6. The bailing and automatic stowing system of claim 1, wherein the octagonal bridle section is of the same height as the octagonal walled container.

7. The bailing and automatic stowing system of claim 1, wherein the packing is made of a material selected from the group consisting of plastic and cardboard.

8. The bailing and automatic stowing system of claim 1, further comprising handles on the octagonal walled container for handling the packings.

9. The bailing and automatic stowing system of claim 1, wherein the female end supports are adaptable to male supports of a second base for stacking the racks.

10. A packing for winding an electric conductor in a reusable bailing and automatic stowing system, the system comprising:

three detachable sections including:

an octagonal walled container section having a bottom wall and eight walls extending upwardly from the bottom wall, each of the eight walls forming a first peripheral wall;

an octagonal bridle section having eight walls and being concentrically situated within the octagonal walled container, the octagonal bridle section having flanges extending radially outwardly toward each of the first peripheral walls, a passage being defined between the first peripheral walls and the octagonal bridle section walls;

a sheath section having internal and external octagonal peripheries mounted within the passage and on top of the octagonal bridle section flanges for reinforcing the passage accommodating the electric conductor;

the octagonal walled container having a second peripheral wall extending downwardly from each of the tops of the first peripheral walls to form a reinforcement of each of the first peripheral walls, each of the first and second peripheral walls having a height in the range of 4 to 6 inches;

reinforced projections disposed on alternating sides of the second peripheral wall;

rabbets disposed on alternating sides on the bottom outer periphery of the octagonal walled container at positions opposite the reinforced projections for coupling with the reinforced projections when one packing is stacked on top of another packing having the same dimensions.

11. A method for bailing and stowing electric conductors into a packing, comprising the steps of:

providing an octagonal walled container having a bottom wall and eight walls extending upwardly from the bottom wall, each of the eight walls forming a first peripheral wall;

placing an octagonal bridle section having eight walls and situating the octagonal bridle section concentrically within the octagonal walled container, the octagonal bridle section having flanges extending radially outwardly toward each of the first peripheral walls, thereby defining a passage between the first peripheral walls and the octagonal bridle section walls, providing a sheath section having internal and external octagonal peripheries mounting the sheath section within the passage and on top of the octagonal bridle section flanges for reinforcing the passage accommodating the electric conductor;

providing the octagonal walled container with a second peripheral wall extending downwardly from each of the tops of the first peripheral walls to form a reinforcement of each of the first peripheral walls, providing reinforced projections on alternating sides of the second peripheral wall;

providing rabbets on alternating sides on the bottom outer periphery of the octagonal walled container at positions opposite the reinforced projections for coupling with the reinforced projections when one packing is stacked on top of another packing having the same dimensions;

winding electric conductors on the passage defined by the octagonal walled container and the octagonal bridle section, stacking the packing to a maximum of seven to form a stowage; and setting four stowages into a first rack, the first rack having a housing consisting of a first rectangular base, the rectangular base having four sections, the rectangular base having four feet with male end supports extending downwards from four corners of the rectangular base and four rigid supports with female end supports vertically disposed from the same four corners of the rectangular base.

12. The method of claim 11, further comprising setting a second rack having a second rectangular base on top of the first rack for stacking a second set of stowage thereby forming a double level, the second base formed by adapting the female end supports with a male end support of a second rectangular base.

* * * * *